United States Patent [19]

Mott

[11] Patent Number: 4,568,084

[45] Date of Patent: Feb. 4, 1986

[54] RACQUET WITH IMPROVED STRING ANCHORAGE

[76] Inventor: Jonathan C. Mott, Olde Forge Cottage, The Common, Worersh, Guildford GU50PJ, England

[21] Appl. No.: 664,605

[22] Filed: Apr. 27, 1984

Related U.S. Application Data

[60] Continuation-in-part of Ser. No. 577,330, Feb. 8, 1984, Division of Ser. No. 335,863, Dec. 30, 1981, abandoned.

[51] Int. Cl.[4] ..... A63B 49/02

[52] U.S. Cl. ..... 273/73 D; 29/433

[58] Field of Search ..... 273/73 D, 73 C, 73 H, 273/73 K, 73 L, 73 R, 73 E, 73 F, 67 R; 24/587, 460; 29/450, 453, 433

[56] References Cited

U.S. PATENT DOCUMENTS 3,664,669 5/1972 Latham et al. ..... 273/73 D 3,815,660 6/1974 Gallagher et al. ..... 273/73 D 3,879,036 4/1975 Portz et al. ..... 273/73 D

FOREIGN PATENT DOCUMENTS 1139999 1/1969 United Kingdom ..... 273/73 D

*Primary Examiner*—Richard C. Pinkham

*Assistant Examiner*—Matthew L. Schneider

*Attorney, Agent, or Firm*—Banner, Birch, McKie & Beckett

[57] ABSTRACT

A racquet has a sinuous string-securing member anchored in a groove around the internal periphery of the racquet frame. An anchoring member, which is wider than the mouth of the groove, engages each mounting portion of the string-securing member, and is trapped in the groove behind the mouth. The anchoring members may be made of nylon, and may be snap-fit over the mounting portions prior to sliding the entire string-securing assembly into the groove.

17 Claims, 4 Drawing Figures

RACQUET WITH IMPROVED STRING ANCHORAGE

This application is a continuation-in-part of copending application Ser. No. 577,330, filed Feb. 8, 1984, which is a division of application Ser. No. 335,863, filed Dec. 30, 1981 and now abandoned.

BACKGROUND OF THE INVENTION

This invention relates to racquets.

A typical racquet comprises an approximately oval frame, usually of wood or extruded aluminum, having a plurality of holes extending substantially radially therethrough, the stringing of the racquet being directly secured to the frame by passing individual strings thereof through the holes. Typically, a given string is passed outwardly through a respective hole in the frame and then inwardly through an adjacent hole.

However, such a racquet suffers from a number of disadvantages. For example, parts of the stringing are at least partly exposed at the radially outer surface of the frame (i.e., between adjacent holes in the frame), and are thus subject to damage as a result of impacts, e.g., with the ground. Also, the strings tend to fret against the frame, especially where they pass over the edges of the radially outer ends of the holes in the frame, this fretting eventually leading to breakage of the strings. Additionally, manufacturing costs are increased by the necessity for drilling and deburring the holes, and providing and fitting grommets in the holes, all of which operations can be labor intensive. Most significantly, the holes in the frame tend to set up stress concentrations so that when the frame is severly stressed, it almost invariably breaks in the region of a hole.

It has already been proposed, in my United Kingdom Patent Application No. 8200722 (Publication No. 2,094,643, published on Sept. 22, 1982), which corresponds to the above-mentioned U.S. Application Ser. No. 577,330, to alleviate the above-mentioned disadvantages by providing a racquet in which the frame has a groove extending around the greater part of its internal periphery. The stringing of this racquet is secured to the frame by means of a one-piece sinuous string-securing member made from a suitably bent length of wire. This member is held in the groove by making the width of the portions of the wire disposed in the groove exceed the width of the mouth of the groove by deforming them or by crimping the mouth of the groove.

This proposal, although it does indeed alleviate the aforementioned disadvantages and provides excellent racquets, nevertheless suffers from a number of production drawbacks. In particular, the deforming and crimping steps can be rather time consuming, and holding the wire string-securing member in the groove during the crimping operation presents some difficulty. Additionally, the frames of racquets in accordance with the proposal are usually made from extruded aluminium, often with highly decorative finishes which are produced, for example, by anodizing. These finishes can be adversely affected by the crimping operation, while the actual deformation produced by the crimping operation can of itself detract somewhat from the pleasing aesthetic appearance of the racquet.

SUMMARY OF THE INVENTION

It is therefore an object of the present invention to provide a racquet which retains the principle advantages of my prior proposal, while nevertheless alleviating its production drawbacks.

According to the present invention, there is provided a racquet comprising a string-supporting frame having a groove extending around the greater part of the internal periphery thereof, the mouth of the groove being narrower than the base of the groove. The stringing is secured to the frame by a sinuous string securing member bent to define a plurality of alternate mounting portions and inwardly projecting string securing loops. The mounting portions are held in the groove by anchoring members each having a channel facing the base of the groove in which a mounting portion is retained. The anchoring members are wider than the mouth of the groove so as to be trapped in the groove behind the mouth.

In a preferred embodiment of the invention, the side walls of the groove converge towards the mouth thereof, and the sides of the anchoring members are shaped to be complementary to the side walls of the groove. Preferably, the cross-sectional shape of the anchoring members is complementary to the cross-sectional shape of the groove. It is further preferred that the mouth of the groove be defined by lips which project toward each other from the side walls.

Advantageously, the anchoring members are made from nylon, and the channels therein are shaped to be a snap-fit over more than half the circumference of the mounting portions. Additionally, the length of each anchoring member, in the direction of the groove, is preferably substantially equal to the length of the mounting portion which it engages.

BRIEF DESCRIPTION OF THE DRAWINGS

The invention will now be described, by way of example only, with reference to the accompanying drawings, of which.

DESCRIPTION

Figure 1:
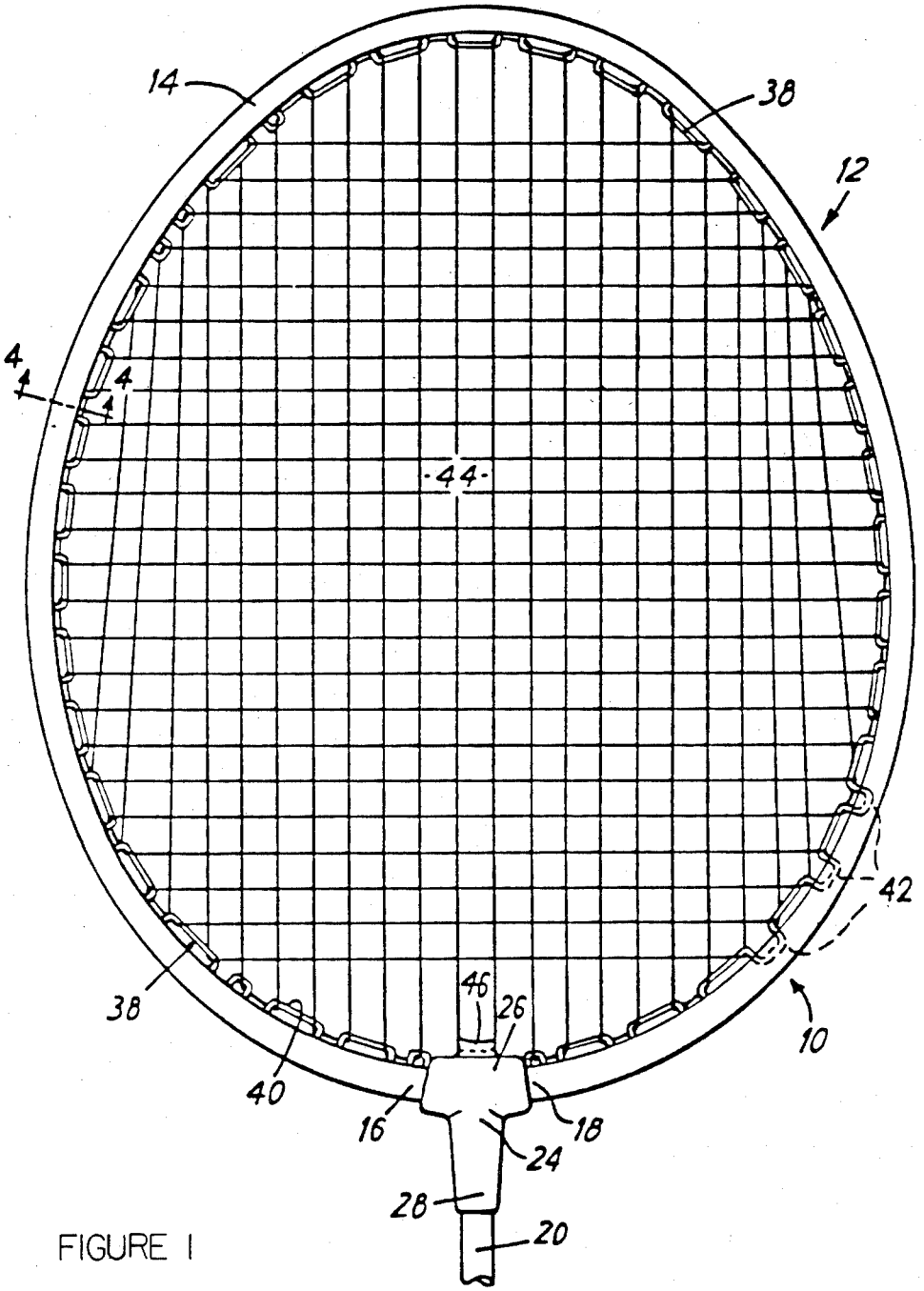
FIG. 1 is a front elevation view of a badminton racquet in accordance with the present invention.

The badminton racquet of FIG. 1 is indicated generally at 10, and comprises a generally toroidal frame 12 which is slightly oval in shape and made from a single length of extruded aluminum tubing 14 bent, e.g., around a former, to produce the oval shape of the frame. The opposite ends 16, 18 of tubing 14 abut each other, and are welded or otherwise bonded together, e.g., with suitable adhesive.

A slim tubular steel handle 20 extends substantially radially of frame 12 and carries at the end remote from the frame a hand-grip (not shown) of wood or plastic. The handle 20 is typically of circular cross-section, and its diameter may either be uniform or increase slightly with increasing distance from frame 12.

Figure 2:
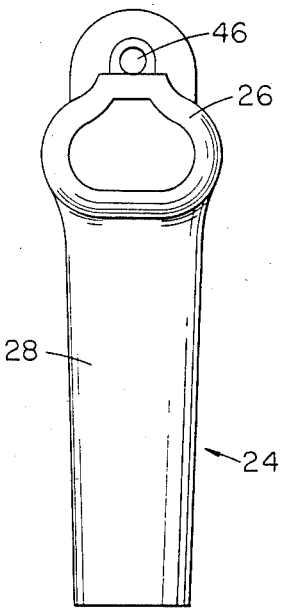
FIGS. 2 and 3 are enlarged front and side elevational views, respectively, of a joining or securing member for securing the handle of the racquet of FIG. 1 to the frame.
Figure 3:
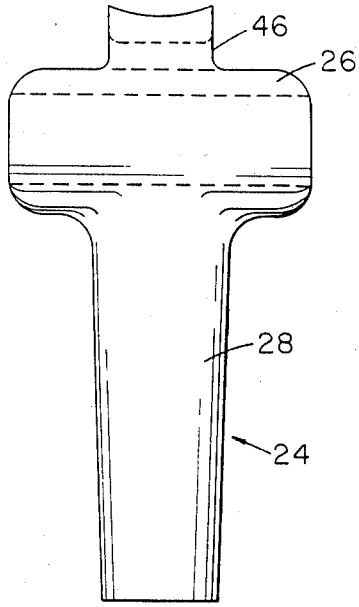

The handle 20 is secured to frame 12 by means of an aluminum member 24, which is shown in more detail in FIGS. 2 and 3. The member 24 comprises first and second integrally formed tubular portions 26 and 28, of which the latter extends perpendicularly from the middle of the former. The first tubular portion 26 is shaped to receive and tightly fit around the bonded-together ends 16, 18 of tubing 14 of the frame, while the second tubular portion 28 extends substantially radially of frame 12 and is shaped to receive and tightly fit around the other end of handle 20. The ends 16, 18 and the other end of handle 20 are bonded within the portions 26, 28 respectively, e.g., with the aforementioned adhesive.

In an alternative construction (not shown), handle 20 is secured to frame 12 by means of a V-shaped member, substantially as described in the above-mentioned U.S. Application Ser. No. 577,330, which is incorporated herein by reference.

Figure 4:
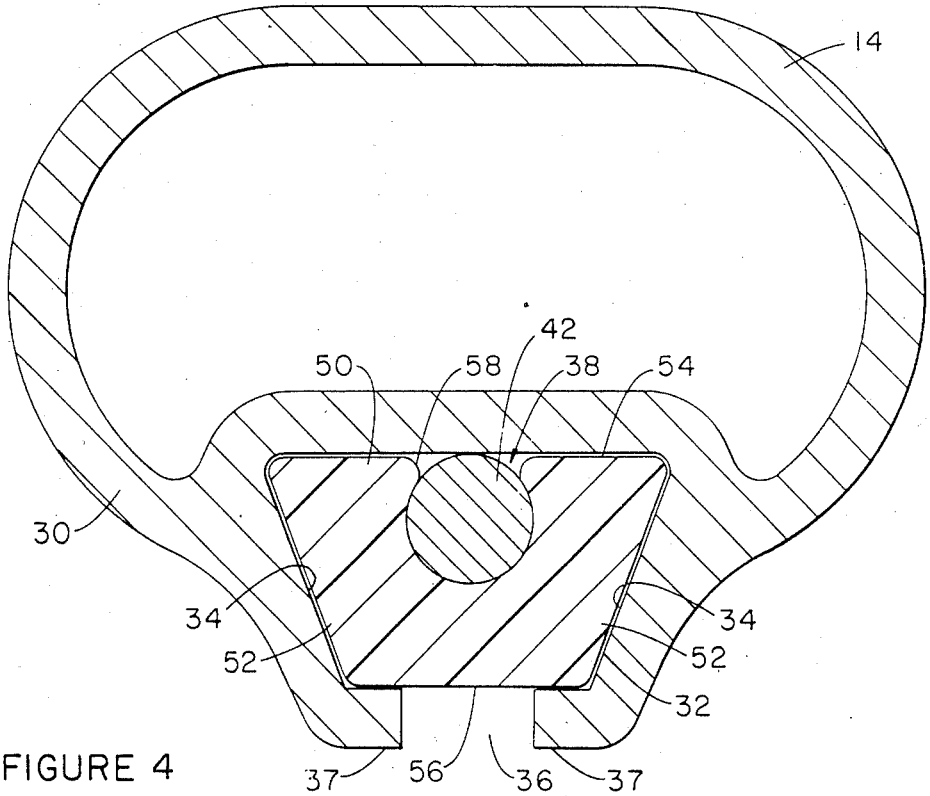
FIG. 4 is an enlarged sectional view taken along line 4—4 in FIG. 1.

The tubing 14 of frame 12 is shown in section in FIG. 4, from which it can be seen that the tubing is of substantially oval section, with the major axis of the oval shape extending perpendicularly to the plane of the frame. The wall thickness of tubing 14 is typically of the order of 1 mm, except for the thicker portion 30 which constitutes the internal periphery of frame 12 when the tubing is bent as described earlier is shaped to define a groove 32.

The side walls 34 of groove 32 converge symmetrically towards the mouth 36 of the groove, which is defined between lips 37 which project towards each other from the side walls 34. The width of mouth 36 of groove 32 is typically very slightly in excess of 1 mm. Groove 32 serves to hold a one-piece wire string-securing member 38, which is trapped in groove 32 beneath a plurality of wedge-shaped nylon anchoring members 50.

As can be seen in FIG. 1, string-securing member 38 comprises a single length of steel wire bent into a sinuous shape resembling castellations or crenellations in side view, and defining a plurality of U-shaped string securing loops 40, of which adjacent ones are integrally joined together at the tops of the limbs of their U-shapes by mounting or connecting portions 42. The diameter of the wire making up member 38 is typically 1 mm, i.e., just less than the width of mouth 36 of groove 32 (FIG. 4).

As already mentioned, the string-securing member 38 is held in groove 32 by a plurality of anchoring members 50 (FIG. 4.) The cross-sectional wedge shape of each anchoring member 50 is substantially complementary to the cross-sectional shape of groove 32, so the members 50 can be slid into groove 32 from one of the ends 16, 18 of the tubing 14 before these ends are bonded together. Members 50 thus have two side faces 52 which engage the side walls 34 of the groove 32, a base 54 which faces the base of the groove, and a top surface 56 which faces out of mouth 36 of the groove and whose edges are trapped beneath the lips 37.

The center of base 54 of each anchoring member 50 has a channel 58 formed therein, the channel extending perpendicularly to the plane of FIG. 4. The channel 58 has a part-circular cross-section, and is shaped and dimensioned to tightly embrace about three quarters of the circumference of the wire of the mounting portions 42 of the string-securing member 38.

To make up racquet 10, an anchoring 50 is clipped or snapped over each mounting portion 42 of string-securing member 38, the resilience of the nylon permitting this snap fit. It will be appreciated that, once snapped into position, members 50 tend to grip onto the mounting portions 42. The length of each anchoring member 50 is chosen to be just less than or equal to the length of the mounting portion 42 onto which it is fitted.

Then, prior to bonding together the ends 16, 18 of bent tubing 14 making up frame 12, anchoring members 50, still mounted on string-securing member 38, are slid together with the mounting portions 42 of member 38 into groove 32, the string securing loops 40 of member 38 being aligned with mouth 36 of the groove to permit this. This continues until the member 38 extends around substantially the whole of the internal periphery of the frame (except for the portions of the frame which fit within the tubular portion 26 of aluminum member 24). End portions 16, 18 of tubing 14 are then bonded together within portion 26 of aluminum member 24, at which point member 38 is firmly held in groove 32 by virtue of the entrapment of mounting portions 42 thereof beneath anchoring members 50, and string securing loops 40 project radially into frame 12 through mouth 36 of the groove, and of course lie in the plane of the frame, as shown in FIG. 1. The racquet 10 then can be strung with stringing 44 by passing the stringing through loops 40, also as shown in FIG. 1.

The widths of the respective string securing loops 40 are not all the same, but are selected such that the desired, e.g., uniform, string spacing is achieved. As can be seen in FIGS. 1 to 3, a single stringing loop 46 is formed integrally with aluminum member 24, projecting radially into frame 12 from portion 26.

It will be appreciated that because the stringing of the racquet is supported on the wire string-securing member 38, which is in turn held in groove 32, it is no longer necessary to drill holes in tubing 14 of frame 12. This eliminates the formation of the stress-concentrations normally associated with such holes, and enables the production of a lighter and/or stronger frame.

It will further be appreciated that, by virtue of the use of nylon anchoring members 50, there is no need to deform mounting portions 42 of wire string-securing member 38 in order to widen them, nor, more importantly, any need to crimp mouth 36 of groove 32. The use of nylon, which has a low coefficient of friction, for members 50 eases assembly by ensuring that they slide easily into groove 32. Assembly also is simplified by the fact that members 50 clip onto and grip the wire of string-securing member 38. The possibility of wire string-securing member 38 pulling out of groove 32 is virtually eliminated, especially since the wedge shape of anchoring members 50 cooperates with side walls 34 of groove 32 to ensure that members 50 grip the wire of member 38 more tightly in response to movement of members 50 towards the mouth 36 of the groove.

It will be obvious to those skiled in the art that variations of the above-described preferred embodiment may be within the scope of the invention, which is defined by the appended claims.

I claim:

1. A racquet comprising:

a string-supporting frame having an internal periphery and a central area located inwardly therefrom for receiving a strung surface, said string supporting frame having a groove extending around the greater part of the internal periphery, said groove having a mouth and a base, said mouth being proximate said central area and being narrower than said base, a sinuous string-securing member having a plurality of spaced mounting portions anchored in the groove and a plurality of spaced string-securing loops projecting inwardly toward said central area from the mouth of the groove; and a plurality of anchoring members in said groove which are wider than said mouth so as to be trapped within said groove behind said mouth, each of said anchoring members having a channel facing the base of the said groove and retaining a respective one of said mounting portions in said channel.

2. A racquet according to claim 1 wherein said channel is dimensioned to fit closely around said mounting portion.

3. A racquet according to claim 2 wherein said channel closely surrounds more than half the perimeter of said mounting portion so that said anchoring member can be snap-fit over said mounting portion.

4. A racquet according to claim 3 wherein the length of each of said anchoring members, in the direction of the groove, is substantially equal to the length of its respective mounting portion.

5. A racquet according to claim 4 wherein said anchoring members are plastic.

6. A racquet according to claim 4 wherein said anchoring members are nylon.

7. A racquet according to claim 2 wherein the cross-sectional shape of the anchoring members is complementary to the cross-sectional shape of the groove.

8. A racquet according to claim 7 wherein said groove and said anchoring members are wedge-shaped in cross-section, the cross-section having tapered sides that taper toward the mouth of said groove so that tension on the strings tends to wedge said anchoring members more tightly in said groove.

9. A racquet according to claim 8 wherein said anchoring members are resilent, whereby said mounting portions are more tightly retained in said channels when said anchoring members are more tightly wedged in said groove.

10. A racquet according to claim 9 wherein said channel closely surrounds more than half the perimeter of said mounting portion so that said anchoring members can be snap-fit over said mounting portions.

11. A racquet according to claim 10 wherein the length of each of said anchoring members, in the direction of the groove, is substantially equal to the length of its respective mounting portion.

12. A racquet according to claim 9 wherein said anchoring members are plastic.

13. A racquet according to claim 9 wherein said anchoring members are nylon.

14. A racquet according to claim 8 wherein said mouth is defined by opposed lips extending from the tapered sides of said groove.

15. A racquet according to claim 1 wherein the cross-sectional shape of the anchoring members is complementary to the cross-sectional shape of the groove.

16. A racquet according to claim 15 wherein said groove and said anchoring members are wedge-shaped in cross-section, the cross-section having tapered sides that taper toward the mouth of said groove so that tension on the strings tends to wedge said anchoring members more tightly in said groove.

17. A racquet according to claim 16 wherein said mouth is defined by opposed lips extending from the tapered sides of said groove.

* * * * *